US010885870B2

(12) United States Patent
Kim et al.

(10) Patent No.: US 10,885,870 B2
(45) Date of Patent: Jan. 5, 2021

(54) DISPLAY DEVICE AND INTERFACE OPERATION THEREOF

(71) Applicant: SAMSUNG ELECTRONICS CO., LTD., Suwon-si (KR)

(72) Inventors: Kyongho Kim, Hwaseong-si (KR); Jinho Kim, Hwaseong-si (KR); Jaeyoul Lee, Hwaseong-si (KR); Hyunwook Lim, Seoul (KR); Youngmin Choi, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 16/814,535

(22) Filed: Mar. 10, 2020

(65) Prior Publication Data

US 2020/0211495 A1 Jul. 2, 2020

Related U.S. Application Data

(63) Continuation of application No. 16/248,553, filed on Jan. 15, 2019, now Pat. No. 10,629,157.

(30) Foreign Application Priority Data

Jun. 5, 2018 (KR) ..... 10-2018-0064769

(51) Int. Cl.
*G09G 5/00* (2006.01)

(52) U.S. Cl.
CPC ..... *G09G 5/003* (2013.01); *G09G 2310/08* (2013.01)

(58) Field of Classification Search
CPC ..... G09G 5/003; G09G 3/20; G09G 3/2092; G09G 3/2096; G09G 2310/08
See application file for complete search history.

(56) References Cited

U.S. PATENT DOCUMENTS

| | | | | |
|---|---|---|---|---|
| 8,125,435 | B2 | 2/2012 | Chen et al. | |
| 8,788,890 | B2 | 7/2014 | Kim et al. | |
| 8,878,828 | B2 | 11/2014 | Baek et al. | |
| 9,053,673 | B2 | 6/2015 | Yuan et al. | |
| 9,857,911 | B1 | 1/2018 | Qu et al. | |
| 10,354,587 | B2 | 7/2019 | Kim et al. | |
| 2010/0085084 | A1* | 4/2010 | Kim | G09G 3/3648 327/108 |
| 2011/0037758 | A1 | 2/2011 | Lim et al. | |
| 2013/0113777 | A1 | 5/2013 | Baek et al. | |
| 2017/0111071 | A1 | 4/2017 | Yoo et al. | |

(Continued)

FOREIGN PATENT DOCUMENTS

| | | | |
|---|---|---|---|
| KR | 20080047875 | A | 5/2008 |
| KR | 20130032718 | A | 4/2013 |

*Primary Examiner* — Sardis F Azongha
(74) *Attorney, Agent, or Firm* — Volentine, Whitt & Francos, PLLC

(57) ABSTRACT

An electronic device includes; a timing controller that generates a command to-be-sent to a display driver integrated circuit (DDI) selected from among a plurality of display driver integrated circuits (DDIs) connected to the timing controller through data lines and a shared channel The DDI is selected by a DDI control signal transferred from the timing controller to the DDI through a corresponding data line among the data lines, and the command is transferred from the timing controller to the DDI through the shared channel.

16 Claims, 7 Drawing Sheets

(56) References Cited

U.S. PATENT DOCUMENTS

| | | | | |
|---|---|---|---|---|
| 2017/0124957 | A1 | 5/2017 | Ahn et al. | |
| 2017/0132966 | A1* | 5/2017 | Lim | G09G 3/2092 |
| 2018/0122294 | A1* | 5/2018 | Do | G09G 3/3275 |

* cited by examiner

DISPLAY DEVICE AND INTERFACE OPERATION THEREOF

CROSS-REFERENCE TO RELATED APPLICATIONS

This is a Continuation of U.S. application Ser. No. 16/248,553, filed Jan. 15, 2019, which claims priority under 35 U.S.C. § 119 to Korean Patent Application No. 10-2018-0064769 filed on Jun. 5, 2018, the subject matter of which is hereby incorporated by reference.

BACKGROUND

The inventive concept relates to electronic devices including a display device. More particularly, the inventive concept relates to apparatuses and methods for controlling interface circuitry between a timing controller and a display driver.

A display device such as a liquid crystal display (LCD) device, a plasma display panel (PDP) device, or a light-emitting diode (LED) device usually includes a display driver integrated circuit (hereinafter, "DDI") that may be used to drive the operation of the display panel. The DDI is a semiconductor chip that is used to drive a huge number of pixels constituting the display device. The DDI controls the operation of these pixels by transferring one or more control signals to create a desired visual image on the display device. Contemporary display devices may include high resolution (e.g., 8K or higher) display panels requiring the use of multiple DDIs (e.g., 24 DDIs in the case of a typical 8K/1G1D display panel).

Respective DDIs may be provided on the display device as separate chips, where each chip may be used to drive a portion of the display panel in response to display data provided by a timing controller. In a commonly used interface approach the timing controller is connected to respective DDIs through a high-speed main link or "data line". However, this interface approach may prove inadequate when a "command" (e.g., an equalizer setting, a bias current setting, a port selection operation, etc.) is communicated (or transferred) from the timing controller to a DDI through the data line, and this inadequacy may be particularly pronounced when the command being transferred is directed to the operation of the data line itself.

SUMMARY

Embodiments of the inventive concept provide an interface approach whereby a command is transferred from the timing controller to a selected DDI using a shared channel. However, embodiments of the inventive concept are not limited to the above-described technical problems, and other technical problems can be deduced from the following embodiments.

In one embodiment, the inventive concept provides an electronic device including: a timing controller that generates a command to-be-sent to a display driver integrated circuit (DDI) selected from among a plurality of display driver integrated circuits (DDIs) connected to the timing controller through data lines and a shared channel, wherein the DDI is selected by a DDI control signal transferred from the timing controller to the DDI through a corresponding data line among the data lines, and the command is transferred from the timing controller to the DDI through the shared channel.

In another embodiment, the inventive concept provides a method of interfacing between a timing controller and a plurality of display driver integrated circuits (DDIs) connected to the timing controller through data lines and a shared channel. The method includes; using the timing controller to generate a command to-be-sent to a display driver integrated circuit (DDI) selected from among the DDIs, detecting a command entry state in response to the generating of the command and upon detecting the command entry mode, entering a command reception mode, and during the command reception mode, selecting the DDI using a DDI control signal transferred to the DDI through one of the data lines connecting the timing controller with the DDI, and transferring the command from the timing controller to the DDI through the shared channel.

In another embodiment, the inventive concept provides a display device including: an application processor, a display panel, and a display driver integrated circuit package configured to receive a signal output from the application processor and to convert the received signal to a signal for controlling the display panel. The display driver integrated circuit package include; a timing controller, and display driver integrated circuits (DDIs) connected to the timing controller through data lines and a shared channel. The timing controller generates a command to-be-sent to a display driver integrated circuit (DDI) selected from among DDIs, the DDI is selected by a DDI control signal transferred from the timing controller to the DDI through a corresponding data line among the data lines, and the command is transferred from the timing controller to the DDI through the shared channel.

BRIEF DESCRIPTION OF THE DRAWINGS

The above and other objects and features of the inventive concept will become apparent by describing in detail exemplary embodiments thereof with reference to the accompanying drawings.

DETAILED DESCRIPTION

Embodiments of the inventive concept will now be described in some additional detail with reference to the accompanying drawings. However, the scope of the inventive concept is not limited to only the illustrated and described embodiments.

Figure 1:
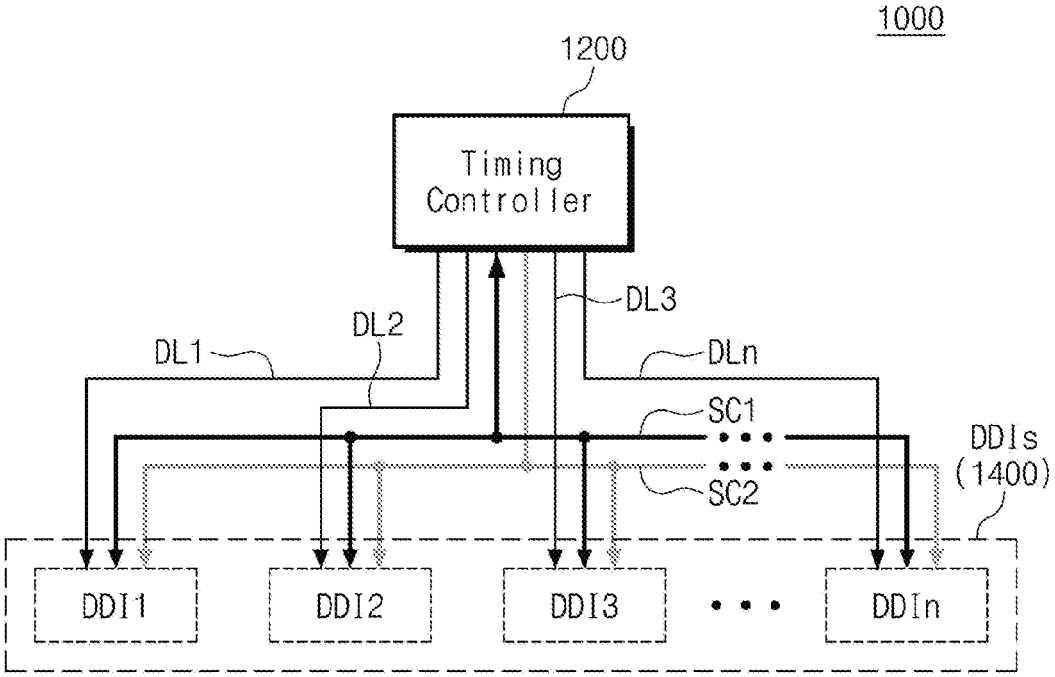
FIG. 1 is a block diagram of an electronic device according to an embodiment.

FIG. 1 is a block diagram of an electronic device 1000 according to an embodiment of the inventive concept.

The electronic device 1000 may be variously implemented as a separate device or as part of a display device (e.g., an LCD device, an LED display device, an OLED display device, or an active matrix OLED display device). In certain embodiments of the inventive concept, the electronic device 1000 may be implemented as a device or part of a device that provides the circuitry and/or components necessary to performing the functions of a DDI, multiple DDIs, whether those DDIs are separately of collectively packaged.

In the illustrated example of FIG. 1, the electronic device 1000 includes a timing controller 1200 variously connected to a plurality, n, of DDIs 1400, wherein 'n' is an integer value greater than 1 (e.g., a first DDI (DDI1), a second DDI (DDI2), a third DDI (DDI3), . . . through an n-th DDI (DDIn)).

The timing controller 1200 may control the performing of various operations by one or more of the DDIs 1400, such as aligning externally supplied data. In this regard, the timing controller 1200 may convert a signal received from an application processor (not shown) into a corresponding DDI control signal that may be decoded by the DDIs 1400, and provide the DDI control signal to at least one of the DDIs 1400.

In the illustrated example of FIG. 1, the timing controller 1200 is connected through respective data lines (e.g., DL1 to DLn) to the DDIs 1400 in a point-to-point manner Thus, a first data line DL1 may be a bus connecting the timing controller 1200 with the first DDI DDI1; a second data line DL2 may be a bus connecting the timing controller 1200 with the second DDI DDI2, and so on.

In certain embodiments of the inventive concept, a differential signaling approach may be used to transferring data through the respective data lines DL1 to DLn. As will be appreciated by those skilled in the art, a voltage swing for signals being transferred through the data lines may be reduced by using a differential signaling approach, thereby also reducing the level of electromagnetic interference (EMI) and potentially improving the overall rate of data transfer to a display panel. Possible differential signaling approaches that may be used in various embodiments of the inventive concept may include; a reduced swing differential signaling (RSDS) adopting a multi-drop approach, a mini-LVDS (Low Voltage Differential Signaling) approach, and a point-to-point differential signaling (PPDS) approach adopting. However, the inventive concept is not limited to only these examples.

Each of the DDIs 1400 may include a circuit (e.g., a delay locked loop (DLL) circuit or a phase locked loop (PLL) circuit) that recovers a clock signal. In this regard, the DDIs 1400 may respectively receive a clock training pattern from the timing controller 1200 through the data lines DL1 to DLn and perform a training operation based on the received training pattern.

As further illustrated in the example of FIG. 1, the DDIs 1400 and the timing controller 1200 may be connected through one or more shared channels (e.g., a first shared channel SC1 and a second shared channel SC2). The first shared channel SC1 and the second shared channel SC2 may be variously implemented, such as a common bus shared by the DDIs 1400. In certain embodiments of the inventive concept, the first shared channel SC1 may be referred to as a "shared back channel", while the second shared channel SC2 may be referred to as a "shared forward channel". However, the inventive concept is not limited thereto. Here, the data transfer rate provided by one or both of the first shared channel SC1 and the second shared channel SC2 may be slower than the data transfer rate provided by the data lines DL1 to DLn using a differential signaling approach.

"State information" for the respective DDIs 1400 may be transferred from the DDIs 1400 to the timing controller 1200 through the first shared channel SC1. In certain embodiments of the inventive concept, the DDIs 1400 may transfer state information indicating whether a clock is unlocked or locked to the timing controller 1200 through the first shared channel SC1. Accordingly, the timing controller 1200 may recognize whether a clock is locked/unlocked on the basis of these signal(s) received through the first shared channel SC1 and provide, as necessary, a clock training pattern to one or more of the DDIs 1400.

Alternatively or additionally, state information transferred between the DDIs 1400 and the timing controller 1200 though the first shared channel SCI may include environmental and/or performance information (e.g., various settings for the DDIs 1400, bit error rate information, temperature information, touch panel conditions and/or settings, luminance settings, luminance information, etc.).

In certain embodiments of the inventive concept, various signal(s) transferred through the first shared channel SC1 between the timing controller 1200 and one or more of the DDIs 1400 may be open-drain type signal responsive to (or controlled in its operative characteristics by) a corresponding pull-up resistor. Hence, the voltage level of such signal(s) may be accurately controlled (or adjusted) using the pull-up resistor.

The electronic device 1000 may define a training period for the DDIs 1400 by transferring a corresponding "training signal" from the timing controller 1200 to the DDIs 1400 through the second shared channel SC2. In certain embodiments of the inventive concept, the electronic device 1000 may enable the performing (or execution) of a defined training operation by one or more of the DDIs 1400 (e.g., when the training signal is logically low (hereafter, "low")), or enable the performing of various data processing operation(s) (e.g., when the training signal is logically high (hereafter, "high")).

The timing controller 1200 and the DDIs 1400 may cooperate to perform a variety of data processing and/or control operation(s) that may involve an what is hereafter referred to as an "interface operation." An interface operation may be performed using the data lines DL1 to DLn, the first shared channel SC1, and/or the second shared channel SC2. As will be appreciated by those skilled in the art, various data processing and data transfer (including one or more interface operations) may be performed in response to one or more commands. There are usually a variety of possible commands that may be transferred from the timing controller 1200 to the DDIs 1400 through the data lines DL1 to DLn that may have a direct influence on the operating characteristics of the DDIs 1400 (e.g., command(s) changing an equalizer setting, a bias current setting, a port selection, etc.). Such commands signals may include various "write" commands setting (or defining) control values for the DDIs 1400 and/or "read" commands interrogating control values. Hence, because the command being transferred may influence the operating characteristics of one or more of the data lines DL1 to DLn, a higher likelihood of transfer error arises. Additionally, since the voltage swing range for signals being transferred through the data lines DL1 to DLn is relatively small, commands being transferred via the data lines DL1 to DLn may prove particularly susceptible to noise affecting the data lines DL1 to DLn.

According to embodiments of the inventive concept, the electronic device 1000 of FIG. 1 may "select" at least one DDI from among the DDIs 1400 (hereafter, "the selected DDI" whether one or more of the DDIs is selected) in response to a differential signal transferred through at least one of the data lines DL1 to DLn. Thereafter, the timing controller 1200 may transfer a command to the selected DDI through the first shared channel SC1. This approach to transferring a command from the timing controller 1200 to the DDIs 1400 through the first shared channel SC1 will be described hereafter in some additional detail.

Figure 2:
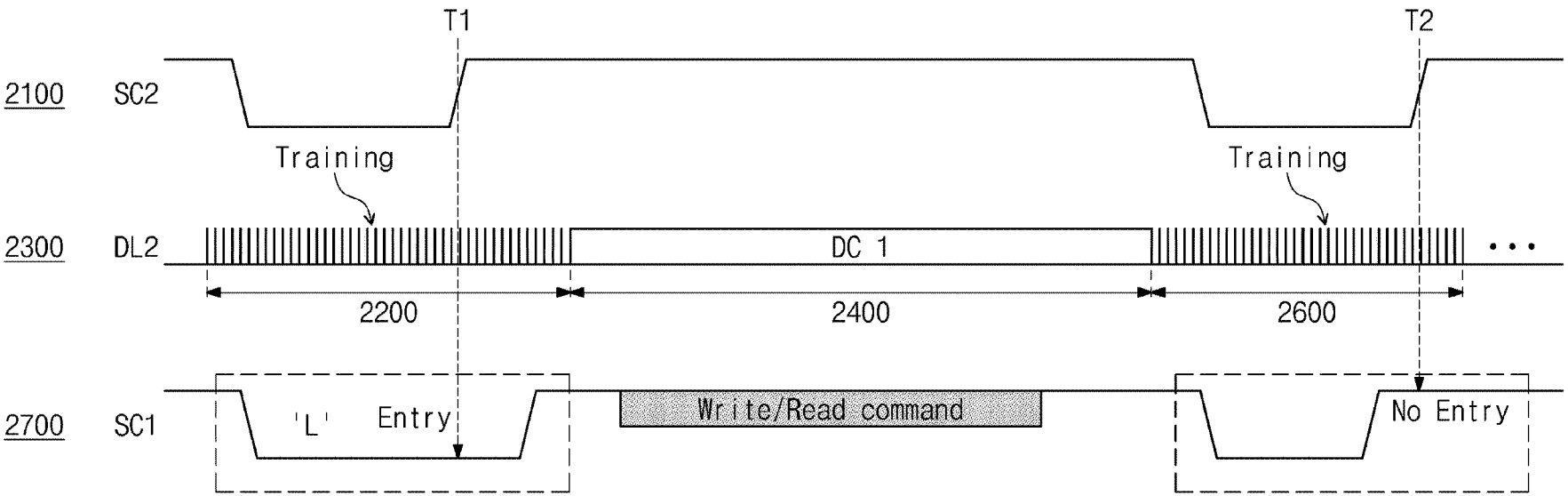
FIG. 2 is a diagram illustrating waveforms of signals on a data line and a shared channel, according to an embodiment.
Figure 3:
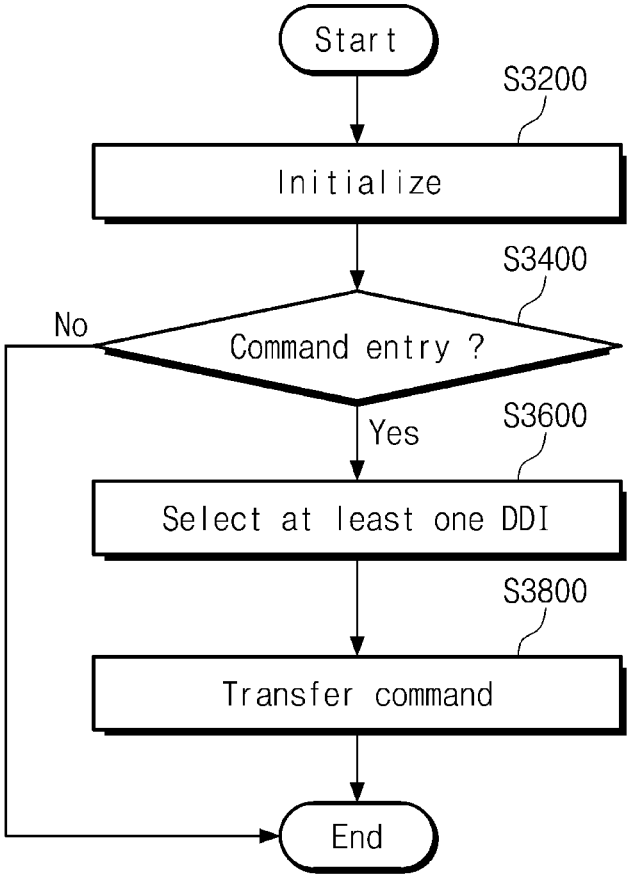
FIG. 3 is a flowchart illustrating a command transfer method performed in an electronic device of FIG. 1, according to an embodiment.
Figure 4A:
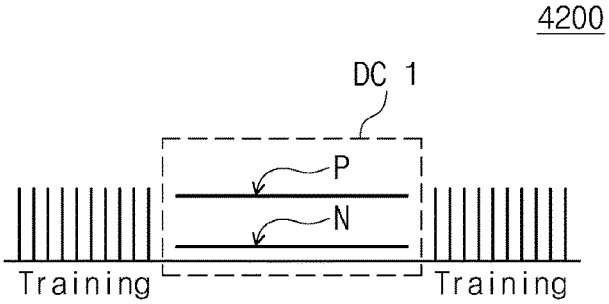
FIGS. 4A to 4D are diagrams illustrating waveforms of a signal on a data line to be used to select a DDI to which a command will be transferred, according to an embodiment.
Figure 4B:
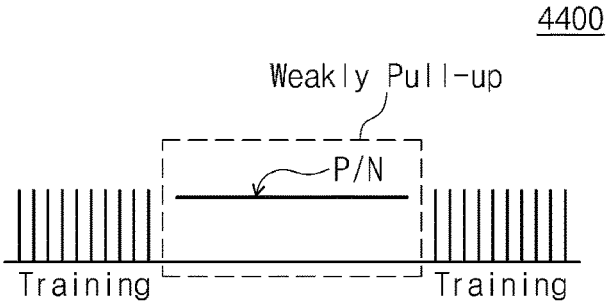
Figure 4C:
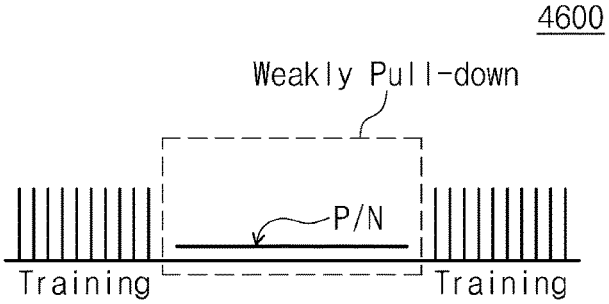
Figure 4D:
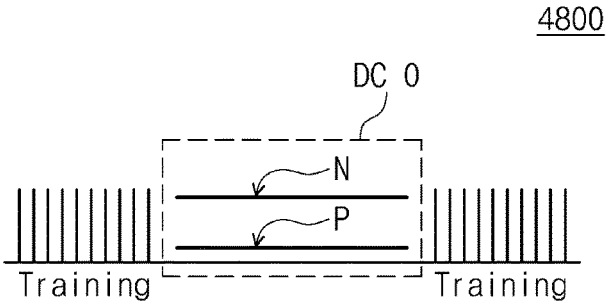

FIG. 2 is a waveform diagram illustrating possible timing relationships between the data lines DL1 to DLn, the first shared channel SC1 and the second shared channel SC2 of FIG. 1. FIG. 3 is a flowchart summarizing a method that may be used to transfer a command between the timing controller 1200 and the DDIs 1400 of FIG. 1. FIGS. 4A, 4B 4C and 4D are respective waveform diagrams for an exemplary signal that may be used to select a DDI from among the DDIs 1400 of FIG. 1 to which a command will be transferred.

Referring to FIG. 2, a waveform 2100 represents the training signal transferred from the timing controller 1200 to one or more of the DDIs 1400 through the second shared channel SC2 of FIG. 1. In the particular example illustrated in FIG. 2 one possible signal that may be transferred from the timing controller 120 to one or more of the DDIs 1400 through the second shared channel SC2 may be used to control the application or non-application of a DDI training pattern to one or more of the data lines DL1 to DLn. Accordingly, the signal waveform 2100 shown in FIG. 2 will be referred to hereafter, for descriptive purposes, as a "training signal". However, those skilled in the art will recognize that other or additional types of signals may be transferred from the timing controller 1200 to the one or more of the DDIs 1400 through the second shared channel SC2.

Also in FIG. 2, a waveform 2300 represents one or more signals that indicate, adjust and/or define performance characteristics of one or more of the DDIs 1400 and are communicated from the timing controller 1200 to the one or more DDIs via one or more of the data lines DL1 to DLn. Accordingly, the signal waveform 2300 shown in FIG. 2 will be referred to hereafter, for descriptive purposes, as the "DDI control signal", regardless of the actual number and type of control signal(s) being transferred. However, those skilled in the art will recognize that other types of signal(s) may be transferred from the timing controller 1200 to the one or more of the DDIs 1400 through the one or more of the data lines DL1 to DLn.

For example, the DDI control signal shown in FIG. 2 includes a first training pattern during a first period 2200 and a second training pattern during a third time period 2600 bracketing a differential signal indication signal during a second, intervening time period 2400. In this illustrative embodiment the DDI control signal is directed to the second DDI DDI2 through the second data line DL2. One example of a possible differential signal indication will be described hereafter in relation to FIG. 4 in which differential signaling is assumed for signals being transferred through the second data line DL2 (i.e., both a positive signal "P signal" and a negative signal "N signal" are transferred through the second data line DL2).

A waveform 2700 represents a "command signal" that may be transferred through the first shared channel SC1. Here again, those skilled in the art will recognize that other types of signal(s) may be transferred from the timing controller 1200 to the one or more of the DDIs 1400 through the first shared channel SC1.

Referring to FIGS. 1, 2 and 3, electronic device 1000 may perform an initialization operation (S3200), where the initialization operation may cause the execution of a training operation by one or more of the DDIs 1400 (e.g., the first and second training periods 2200 and 2600 for the second DDI DDI2). Accordingly, the second DDI DDI2 may perform a training operation during one or both of the first time period 2200 and the third time period 2600 using (e.g.,) a clock training pattern received in the second DDI DDI2 through the second data line DL2 from the timing controller 1200.

After execution of the initialization operation (S3200), the electronic device 1000 determines whether a "command entry state" is detected (S3400). For example, the command entry state may be detected when one or more of the DDIs 1400 recognizes that a command is pending (i.e., is "to-be-sent") from the timing controller 1200. In this regard, the command entry state may be determined in response to one or more signals transferred through the first shared channel SC1 and/or second shared channel SC2.

The electronic device 1000 may determine that the command entry state is indicated (or detected) by interrogating signals (e.g.,) on the first shared channel SC1 and the second shared channel SC2 in relation a defined command reception condition. For example, a "command reception condition" may be indicated when the training signal on the second shared channel SC2 is rising (e.g., transitioning from low to high at time T1) while the logical state of the command signal on the first shared channel SC1 is low. However defined in relation to various embodiments of the inventive concept, an indication of a command reception condition may be recognized by one or more of the DDIs 1400. In contrast to the foregoing, exemplary indication of a command reception condition at time T1 in FIG. 2, no command reception condition is indicated at time T2 of FIG. 2, since the rising training signal occurs while the command signal is high.

Upon determining that a command entry state is detected in the method of FIG. 3 (S3400=Yes), the electronic device 1000 enters an operating mode for receiving a command (hereafter, the "command reception mode"). In the command reception mode, the electronic device 1000 essentially performs a ready operation for transferring a command using the command signal transferred through the first shared channel SC1. For example, the electronic device 1000 may temporarily halt the transfer of a clock locking signal through the first shared channel SC1 in order to transfer the command. That is, since the timing controller 1200 controls the signal nature and use of the first shared channel SC1, the first shared channel SC1 may be temporarily co-opted to transfer the command from the timing controller 1200 to the second DDI DDI2.

In this regard, the operating mode of DDIs 1400 may also be changed in response to detection of a command reception mode. For example, during a time period defined by the command reception mode, the DDIs 1400 may operate in response to an internally generated clock rather than a clock recovered by operation of respective clock recovery circuit(s). The foregoing mode change may occur in deference to reliability considerations for data input to and/or output from the DDIs 1400 during a time in which possible mismatches in clock frequencies may arise between the timing controller 1200 and the DDIs 1400 (e.g., a time period extending from an end of a training operation to receipt of the command)

Thus, during the command reception mode, the electronic device 1000 may select at least one DDI among the DDIs 1400 to receive the command. As previously noted, differential signaling (e.g., a combination of P signal and N signal) may be used to transfer data to the DDIs 1400 through the data lines DL1 to DLn. The selected DDI may be determined in response to a combination of the P signal and the N signal which each of the DDIs 1400 receives through a respective one of the data lines DL1 to DLn.

In certain embodiments of the inventive concept the differential signal may correspond to a chip select condition for the respective DDIs. A chip selection condition (or data state) for one or more of the data lines DL1 to DLn may be indicated by the differential signal. For example a first data state shown in FIG. 4A (4200) may be defined by a high P signal and a low N signal indicating a DC 1 state; a second data state shown in FIG. 4B (4400) may be defined by high P signal and high N signal indicating a weakly pull-up state; a third data state shown in FIG. 4C (4600) may be defined by a low P signal and a low N signal indicating a weakly pull-down state; and a fourth data state shown in FIG. 4D (4800) may be defined by a low P signal and a high N signal indicating a DC 0 state.

Returning again to FIG. 2, it is assumed that the electronic device 1000 is presently in the DC 1 state, selects the second DDI DDI2, and then transfers the command to the second DDI DDI2 through the first shared channel SC1. The second DDI DDI2 then receives the command during the second period 2400 as the second data line DL2 satisfies the chip select condition. Thus, to transfer a command to the second DDI DDI2, the timing controller 1200 may select the second DDI DDI2 by controlling the DDI control signal applied to the second data line DL2 connected to the second DDI DDI2. Using this signaling approach, no additional pad or related connective element(s) is needed to enable/disable selection of the DDIs 1400.

It should be noted at this point that transfer of a command to other DDIs (e.g., DDI1, DDI3, and/or DDIn) is not precluded by the exemplary waveform shown in FIG. 2. It is possible that the command (or a different command) may be transferred to the other "selected" DDIs in response to respective DDI control signal(s) transferred through corresponding data lines (e.g., DL1, DL3, and/or DLn) that satisfy the current chip select condition. For example, to transfer commands to all of the DDIs 1400 in parallel, the timing controller 1200 may generate DDI control signals associated with all the data lines DL1 to DLn associated with the DDIs 1400 such that the DDI control signals satisfy the chip select condition. Commands respectively transferred to the DDIs 1400 may be the same command or different commands Returning again to FIG. 3, the electronic device 1000 may perform a command transfer operation (S3800). A command may be transferred to the at least one DDI selected in operation S3600 through the first shared channel SC1. A DDI (e.g., the second DDI DDI2 in the illustrated example of FIG. 2) receiving the command may change various settings in response to the received command, and may return an indication of the changed settings to the timing controller 1200 through the data lines DL1 to DLn or the shared channels SC1 and SC2.

The transfer of a command to the DDIs 1400 may end when a current frame ends (i.e., when a next training operation is performed). Thus, when a current frame ends the electronic device 1000 may again perform the training operation on the DDIs 1400, and a clock locking signal associated with the DDIs 1400 may be provided. However, even before a current frame ends, the transfer of a command to each of the DDIs 1400 may individually (or respectively) ended in response to a corresponding DDI control signal transferred through one of the data lines DL1 to DLn (e.g., a deselect pattern).

Figure 5:
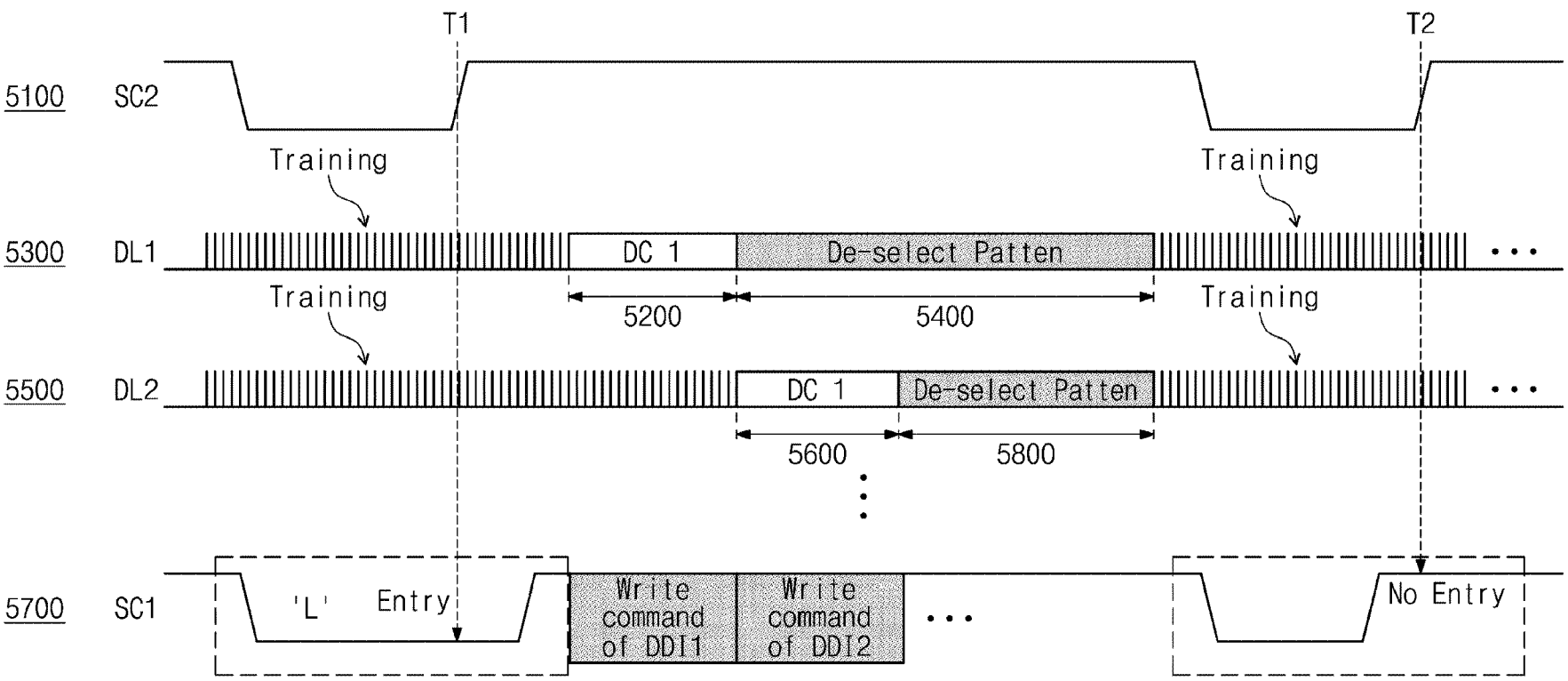
FIG. 5 is a diagram illustrating waveforms of signals on a data line, a first shared channel, and a second shared channel associated with two different DDIs, according to an embodiment.

FIG. 5 is a waveform diagram illustrating various signals that may be transferred through the first data line DL1, the second data line DL2, the first shared channel SC1, and the second shared channel SC2 in order to respectively control the transfer of a command to each one of the first DDI DDI1 and the second DDI DDI2 among the DDIs 1400 according to an embodiment of the inventive concept.

Here again, the first and second shared channels SC1 and SC2 are commonly connected to the DDIs 1400. Waveform 5100 represents a training signal transferred to the DDIs 1400 through the second shared channel SC2, and waveform 5700 represents a command signal that is transferred through the first shared channel SC1 to at least the first DDI DDI1 and the second DDI DDI2. Waveform 5300 represents a first DDI control signal transferred through the first data line DL1 to the first DDI DDI1, and waveform 5500 represents a second DDI control signal transferred through the second data line DL2 to the second DDI DDI2.

At time T1, since the training signal on the second shared channel SC2 is rising and the command signal on the first shared channel SC1 is low, the first DDI DDI1 and the second DDI DDI2 recognize that a command is pending from the timing controller 1200.

During a first period 5200, the first DDI DDI1 receives a high P signal and a low N signal through the first data line DL1. Accordingly, the differential signal on the first data line DL1 satisfies the chip select condition and the first DDI DDI1 may receive a first command (e.g., a write command) through the first shared channel SC1.

Once the first command is received and during a subsequent second period 5400, a deselect pattern signal for deselecting the first DDI DDI1 is transferred to the first DDI DDI1 through the first data line DL1. That is, one of "DC 0", "weakly pull-up", or "weakly pull-down" states, as described with reference to FIGS. 4A to 4D, may be used as the deselect pattern signal. However, the inventive concept is not limited thereto.

During a third period 5600 following the first period, the second DDI DDI2 may receive a high P signal and a low N signal through the second data line DL2. Accordingly, during the third period 5600 in which a differential signal on the second data line DL2 satisfies the chip select condition, the second DDI DDI2 may receive a second command (e.g., a write command) through the first shared channel SC1. Once the second command is completely received, during a fourth period 5800 following the third period 5600, a deselect pattern signal for deselecting the second DDI DDI2 may be transferred to the second DDI DDI2 through the second data line DL2.

Finally, at time T2, when the training signal on the first shared channel SC1 again rises but the command signal on the second shared channel SC2 not low, the electronic device 1000 it may be determined that a current state is not the command entry state.

From the foregoing embodiment those skilled in the art will recognize that the timing controller 1200 may independently transfer command(s) to the DDIs 1400 by selectively defining the nature and timing of DDI control signals respectively applied to the data lines DL1 to DLn.

Figure 6:
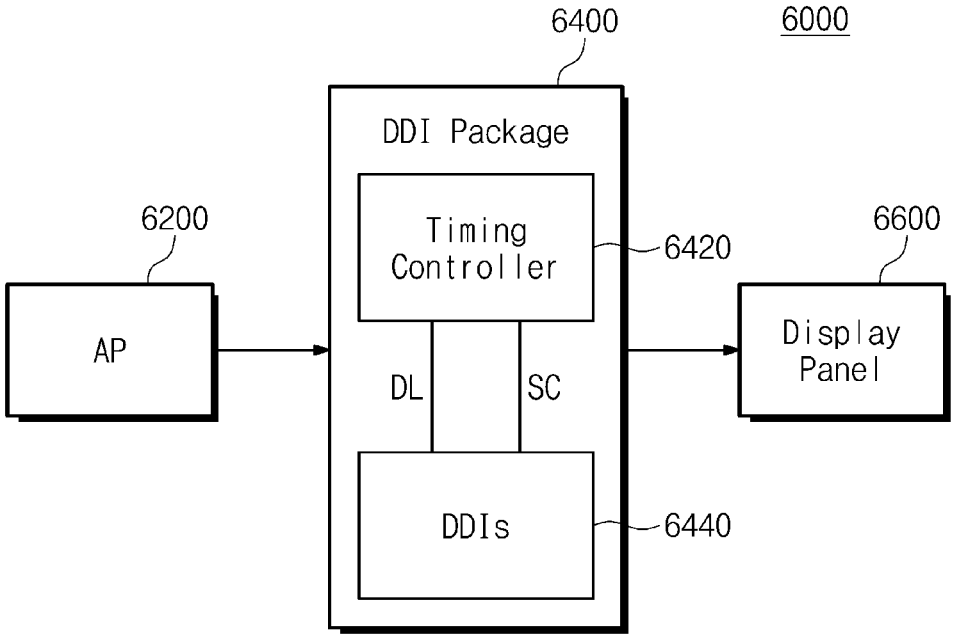
FIG. 6 is a block diagram illustrating a display device which an electronic device of FIG. 1 adopts, according to an embodiment.

FIG. 6 is a block diagram illustrating a display device incorporating the electronic device 1000 of FIG. 1 according to an embodiment of the inventive concept.

Referring to FIG. 6, a display device 6000 may include an application processor (AP) 6200, a DDI package 6400, and a display panel 6600.

A data signal output from the application processor 6200 may be transferred to the DDI package 6400. For example, in the case where a user operates the display device 6000, a signal may be output from the application processor 6200 for the purpose of driving the display panel 6600, and the output signal may be transferred to the DDI package 6400 through a printed circuit board (not shown). As an intermediate connector, the printed circuit board is an electronic part composed of circuits which may transfer electrical signals. According to an embodiment, a flexible printed circuit board may be used as the printed circuit board.

The DDI package 6400 may correspond to the electronic device 1000 of FIG. 1. The DDI package 6400 may include a timing controller 6420 and DDIs 6440.

Functions of the timing controller 6420 and the DDIs 6440 and an interface operation between the timing controller 6420 and the DDIs 6440 may be the same or similar to those described with reference to FIGS. 1 to 5. That is, the timing controller 6420 and the DDIs 6440 may be communicatively connected through data lines DL1 to DLn, the first shared channel SC1 and the second shared channel SC2. At least one DDI, to which a command will be transferred, from among the DDIs 6440, may be selected based on a differential signal transferred through a corresponding data line. Also, a command entry state may be determined based on a signal transferred through the first shared channel SC1 and/or the second shared channel SC2. Once the DDI package 6400 is in the command entry state, it may transfer a command to the DDIs 6440 from the timing controller 6420 through the second shared channel SC2.

As suggested by the illustration of FIG. 6, the multiple shared channels (e.g., SC1 and SC2) may be implemented as a single shared channel (SC).

Accordingly, since the display device 6000 does not use a separate pad or a separate external element for the purpose of identifying a DDI to which a command will be transferred, it is possible to stably transfer a command through the shared channel SC being a low-speed bus.

According to one embodiment of the inventive concept, since the DDI package 6400 performs an interface operation with the timing controller 6420, the DDI package 6400 may include a graphic Random Access Memory (RAM, not shown) for temporarily storing data or a signal to be input to the DDIs 6440. Also, the DDI package 6400 may include a power source (not shown) which generates a voltage for driving the display panel 6600 and supplies the generated voltage to the DDIs 6440.

Figure 7:
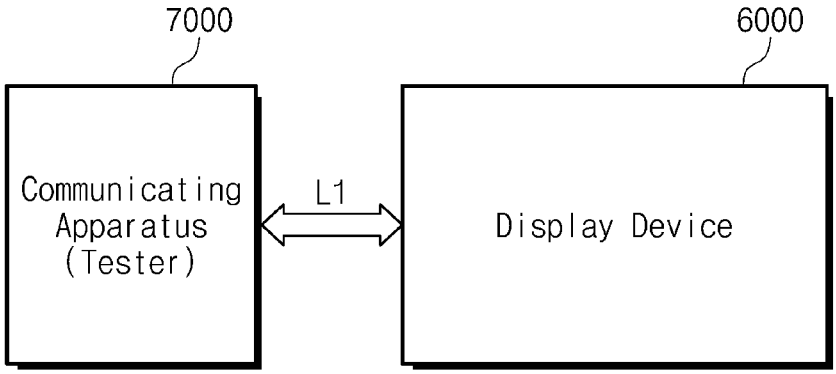
FIG. 7 is a block diagram illustrating connection of a display device of FIG. 6 with a communicating apparatus, according to an embodiment.

FIG. 7 is a block diagram illustrating a possible connection between the display device 6000 of FIG. 6 and a communicating apparatus according to an embodiment of the inventive concept.

Referring to FIG. 7, the display device 6000 may be connected with a communicating apparatus 7000 through a system bus L1. The communicating apparatus 7000 may include, for example, a digital versatile disc (DVD) player, a computer, a set top box (STB), a game console, a digital camcorder, a processor of a mobile phone, etc.

In the case where the display device 6000 is a monitor and the communicating apparatus 7000 is a computer, an image may be displayed in a monitor based on data provided from storage of the computer. The storage may be used to store data information having various data forms such as a text form, a graphic form, and a software code form. For example, the storage may include an electrically erasable programmable read-only memory (EEPROM), a flash memory, a magnetic RAM (MRAM), a spin-transfer torque MRAM (STT-MRAM), a conductive bridging RAM (CBRAM), a ferroelectric RAM (FeRAM), a phase change RAM (PRAM) called a "ovonic unified memory (OUM)", a resistive RAM (RRAM or ReRAM), a nanotube RRAM, a polymer RAM (PoRAM), a nano floating gate memory (NFGM), a holographic memory, a molecular electronics memory device, or an insulator resistance change memory.

The computer may include a CPU, a RAM, a user interface, a modem including a function of a baseband chipset, and a memory system. The CPU of the computer may be mounted in the form of a multi-processor. Also, the computer may further include an application chipset, a camera image processor (CIS), a mobile DRAM, etc.

In FIG. 7, in the case where the communicating apparatus 7000 is used as a tester for testing the display device 6000, the communicating apparatus 7000 may receive bit error rate test data or panel touch data from the timing controller 6420 of the display device 6000. Also, the communicating apparatus 7000 may receive temperature data output from a temperature sensor or luminance data output from a color sensor. The communicating apparatus 7000 may receive state information or option information (setting values such as an equalizer option, a bias current option, and a port selection option) of the DDIs 6440 which the timing controller 6420 receives from the DDIs 6440.

Figure 8:
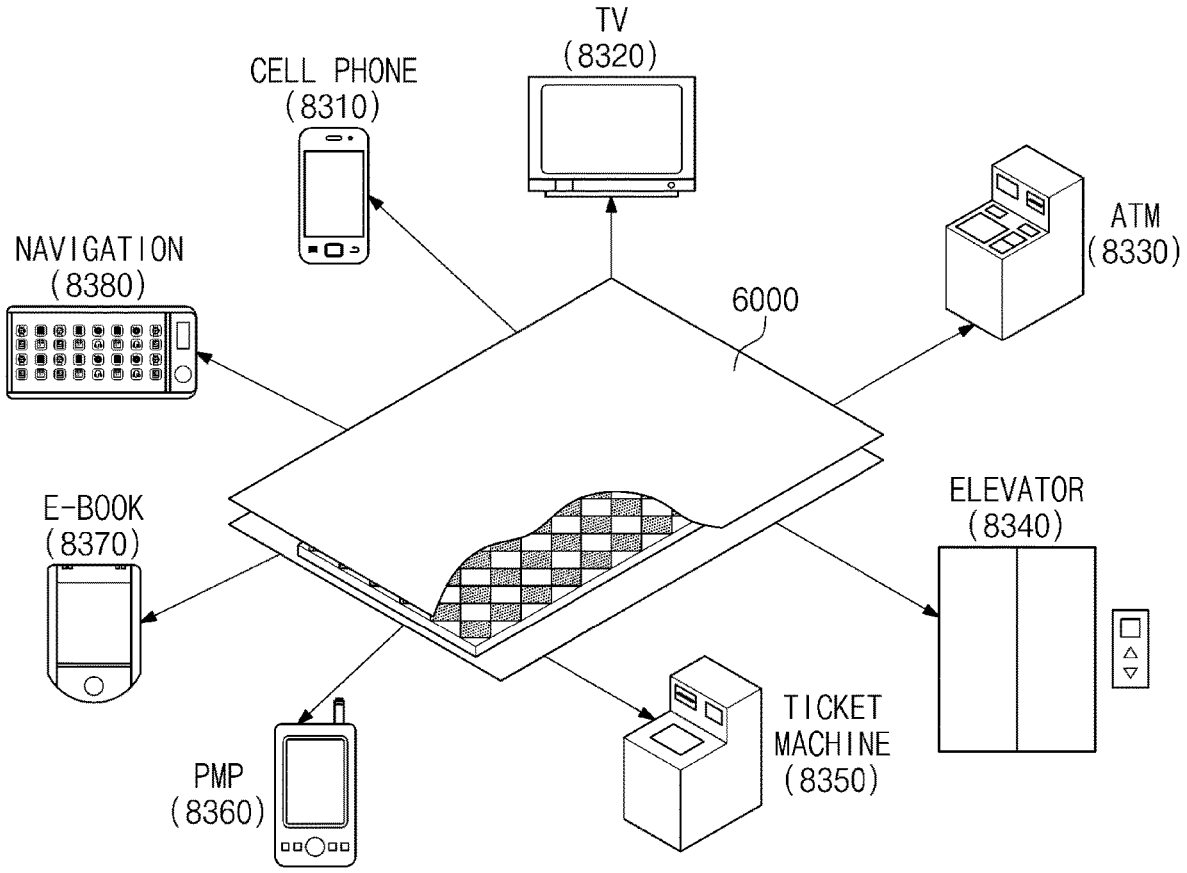
FIG. 8 is a block diagram illustrating various applications to which a display device of FIG. 6 is applied, according to an embodiment.

FIG. 8 is a block diagram illustrating various applications to which the display device 6000 of FIG. 6 may be applied according to various embodiments of the inventive concept.

Referring to FIG. 8, the display device 6000 may be adopted for a cellular phone 8310. Of course, the display device 6000 may be widely used for an LCD or PDP TV 8320, an ATM 8330, an elevator 8340, a ticket machine 8350, a PMP 8360, an e-book 8370, a navigation 8380, etc. The display device 600 may adopt a system of a touch screen type in all fields in which a user interface is necessary.

An electronic device according to an embodiment may use a signal on a data line being a high-speed channel for the purpose of selecting a DDI to which a command will be transferred, and the command may be transferred through a shared channel being a low-speed channel. Accordingly, the command may be stably transferred. Also, since a signal on a data line is used to select a DDI to which a command will be transferred, the electronic device does not require an additional pad or element for tagging identification information for the DDI.

While the inventive concept has been described with reference to exemplary embodiments thereof, it will be apparent to those of ordinary skill in the art that various changes and modifications may be made thereto without departing from the spirit and scope of the inventive concept as set forth in the following claims.

What is claimed is:

1. A display driver circuit (DDI) comprising a circuit configured to receive a DDI control signal including a clock training pattern via a first channel at a first data transfer rate, to perform a training operation based on the clock training pattern, wherein the DDI is configured to receive a training signal that defines a training period for the DDI via a second channel from a timing controller, wherein the DDI is configured to receive a command signal via a third channel at a second data transfer rate from the timing controller, wherein the first data transfer rate is faster than the second data transfer rate, wherein the DDI control signal defines a chip selection condition, wherein the first to third channels are different from each other, and wherein the DDI is configured to connect to the timing controller via the first channel in a point to point manner.

2. The DDI of claim 1, wherein the DDI control signal includes a differential signal including a positive signal and a negative signal.

3. The DDI of claim 1, wherein the DDI is configured to receive the training signal at a third data transfer rate slower than the first data transfer rate.

4. The DDI of claim 3, wherein the DDI is configured to transfer state information of the DDI via the third channel to the timing controller.

5. The DDI of claim 4, wherein the state information includes performance information of the DDI.

6. The DDI of claim 1, wherein the command signal includes one of a write command or a read command.

7. The DDI of claim 6, wherein the DDI recognizes whether one of the write command or the read command is pending or not using signals received from the second channel and the third channel.

8. The DDI of claim 1, wherein the circuit includes one of a delay locked loop circuit or a phase locked loop.

9. A display driver circuit (DDI) comprising a circuit configured to receive a DDI control signal including a clock training pattern via a first channel at a first data transfer rate, to perform a training operation based on the clock training pattern, wherein the DDI is configured to receive a training signal via a first shared channel from a timing controller, wherein the DDI is configured to receive a command signal via a second shared channel from the timing controller, wherein the DDI is configured to receive a write command via the second shared channel when the training signal changes from a first state to a second state at time T1 and the command signal is in the first state at the time T1.

10. The DDI of claim 9, wherein the DDI is configured to transfer state information of the DDI via the second shared channel to the timing controller.

11. The DDI of claim 9, wherein the DDI is configured to receive the command signal at a second data transfer rate slower than the first data transfer rate.

12. The DDI of claim 9, wherein the DDI is configured to receive the write command at time T2 after the command signal changes from the first state to the second state, and wherein the T2 is later than the T1.

13. The DDI of claim 9, wherein the DDI control signal includes a differential signal including a positive signal and a negative signal.

14. The DDI of claim 9, wherein the DDI is configured to connect to the timing controller via the first channel in a point to point manner.

15. The DDI of claim 9, wherein the circuit is one of a delay locked loop circuit or a phase locked loop.

16. The DDI of claim 9, wherein the DDI control signal defines a chip selection condition.

* * * * *